US006648191B2

(12) United States Patent
Giggleman

(10) Patent No.: US 6,648,191 B2
(45) Date of Patent: Nov. 18, 2003

(54) ARTICLE CARRYING HARNESS AND METHOD OF USE

(76) Inventor: Carl P. Giggleman, 642 Wellington Pkwy., New Lenox, IL (US) 60451

( * ) Notice: Subject to any disclaimer, the term of this patent is extended or adjusted under 35 U.S.C. 154(b) by 0 days.

(21) Appl. No.: 10/040,426

(22) Filed: Jan. 9, 2002

(65) Prior Publication Data

US 2003/0127479 A1 Jul. 10, 2003

(51) Int. Cl.[7] ..... A45F 3/04

(52) U.S. Cl. ..... 224/260; 224/254; 224/258; 224/259; 224/908; 224/909

(58) Field of Search ..... 224/260, 259, 224/258, 262, 647, 648, 645, 250, 251, 254, 909, 150, 908; 2/2, 44, 45

(56) References Cited

U.S. PATENT DOCUMENTS 741,098 A * 10/1903 Bibler ..... 224/260
4,168,022 A * 9/1979 Brewer ..... 224/257
4,461,411 A * 7/1984 Harrow ..... 224/617
5,016,797 A * 5/1991 Rowledge ..... 224/257
5,323,942 A * 6/1994 Dahan ..... 224/639
5,360,149 A * 11/1994 Lucot ..... 224/257
5,551,081 A 9/1996 Starnes et al.
5,632,428 A * 5/1997 Weiss ..... 224/623
5,692,661 A * 12/1997 Kellerman ..... 224/648
5,816,460 A * 10/1998 Cook ..... 224/260
5,820,000 A * 10/1998 Timberlake et al. ..... 224/219
6,006,970 A * 12/1999 Piatt ..... 224/257

* cited by examiner

*Primary Examiner*—Gregory Vidovich
*Assistant Examiner*—Maerena Brevard
(74) *Attorney, Agent, or Firm*—Clark & Brody

(57) ABSTRACT

A harness for carrying articles comprises a number of straps for article supporting the article during use and storage as well as distributing its weight on a user's body. The harness includes a neck strap and torso attaching straps which help distribute the article's weight. A pair of stretchable straps are provided which hold the article against excessive movement. Another set of straps independently supports the article when being used.

16 Claims, 3 Drawing Sheets

ARTICLE CARRYING HARNESS AND METHOD OF USE

FIELD OF THE INVENTION

The present invention is directed to an article carrying harness, and in particular, to a harness for carrying articles used in connection with hunting or other leisure activities that lessens the strain on a user's neck and keeps the article secure when not in use.

BACKGROUND ART

In the sport of hunting, binoculars are often used to detect game. One problem with binoculars is their weight and the strain imposed on a user's neck when the binoculars are not being used. Another problem with binoculars is that they can make noise during hunting, such noise drawing attention to a hunter and scaring game away.

Accordingly, a need exists for improved harnesses for carrying binoculars and the like, particularly for hunting purposes.

The present invention solves this need by providing an article carrying harness that is comfortable to wear, and securely holds the article in place when not in use.

It is known to use straps for neck support as disclosed in U.S. Pat. No. 5,551,081 to Starnes. However, this strap is not intended for carrying articles.

SUMMARY OF THE INVENTION

It is a first object of the present invention to provide an improved harness to carry articles such as cameras, binoculars, global position system devices, and the like.

Another object of the invention is a harness for carrying articles that employs a padded neck strap for comfort and expandable bands to secure the article when not in use.

Another object of the invention is a carrying strap that wraps around the neck and body of a user to even distribute the weight of the carried article.

Other objects and advantages of the present invention will become apparent as a description thereof proceeds. One embodiment of the invention includes an article carrying harness comprising a neck strap of defined length and a pair of torso securement straps connected thereto. Each securement strap has a free end and a length so that the free ends can be positioned in a user's lower lumbar region. Means for joining the free ends together at the use's lower lumbar region are provided as are a pair of stretchable article supporting straps. One end of each article supporting strap extends from either the neck strap or a respective securement strap, the other end of each supporting strap having means for attaching to a portion of an article to be carried.

The harness also includes a pair of stretchable bands extending between the securement straps and disposed between the supporting straps and the free ends. The stretchable bands form an opening to receive and retain a portion of the article being carried.

The securement straps and the supporting straps can be adjustable in length. The means for attaching can comprise plastic rotatable loops attached to the supporting straps. The harness can also include a support strap extending between the securement straps. The article to be carrier can be one of a pair of binoculars, a camera, and a global position system device. The neck strap can be padded.

The invention also includes a method of carrying and using an article comprising providing an article carrying harness on a user that includes first and second pairs of stretchable straps. A second step involves attaching the ends of the first pair of stretchable straps to the article. The straps of the second pair can be stretched apart or away from each other to form an opening and a portion of the article can be inserted into the opening. When the straps are released, the inserted portion of the article is secured in the harness. The inserted portions can be removed from the second pair of straps while keeping the ends of the first pair attached to the article. The first pair of straps can then be stretched when using the article. The article can be one of a pair of binoculars, a camera, and a global position system device. The inventive method can use a harness employing the features described above.

BRIEF DESCRIPTION OF THE DRAWINGS

Reference is now made to the drawings of the invention wherein.

DESCRIPTION OF THE PREFERRED EMBODIMENTS

The present invention offers significant improvements in carrying articles, particularly those articles that are commonly used in hunting, e.g., binoculars, global positioning system devices, cameras, etc. The carrying harness is advantageous in a number of ways: it better distributes the weight of the carried article; it secures the article when not in use so as to reduce noise generated by movement of the article when a user is moving; it reduces back fatigue by pulling in a user's lower lumbar region; its padded neck support reduces fatigue; and rubbing damage is minimized by using rotatable article supports.

Figure 1:
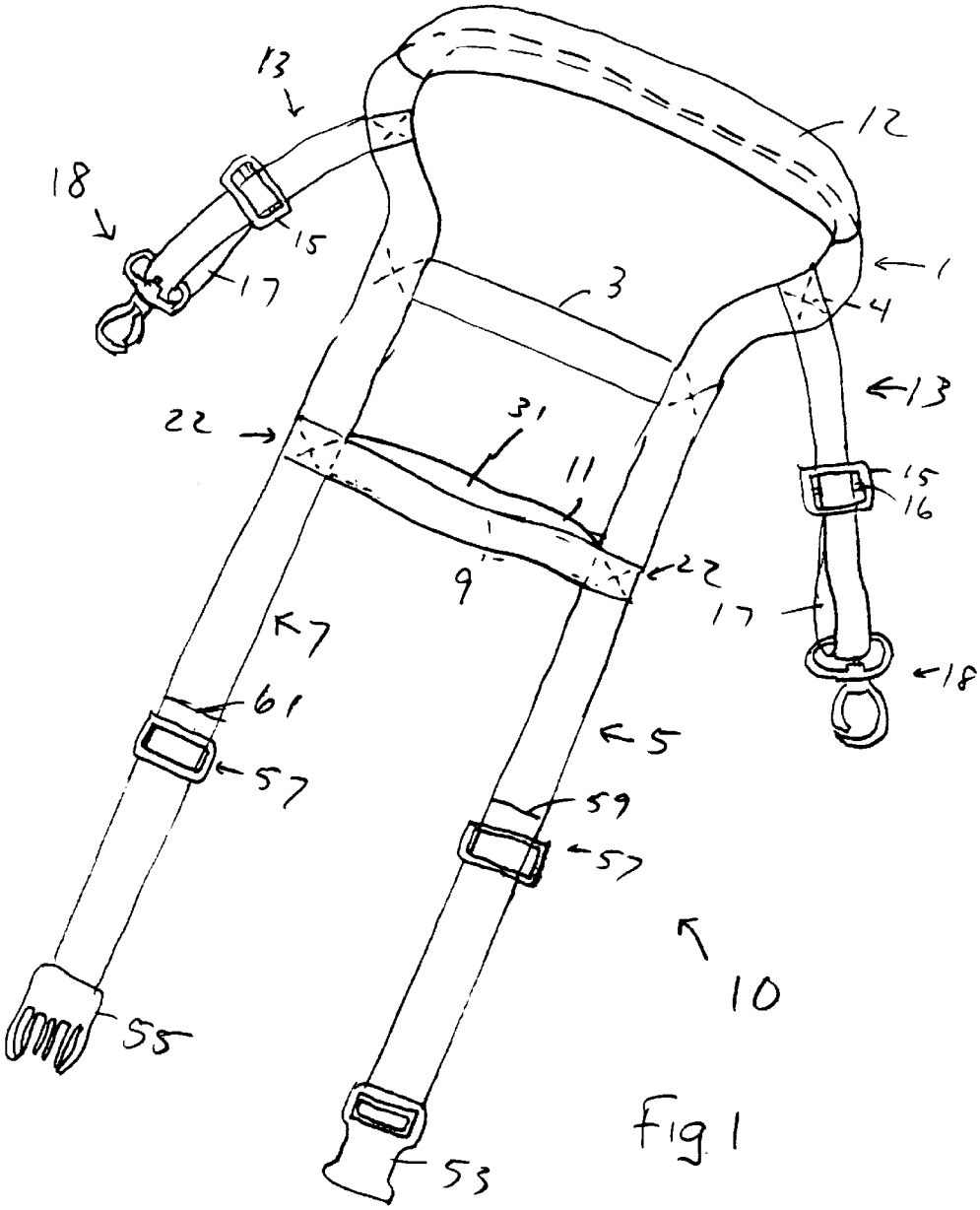
FIG. 1 shows a perspective view of one embodiment of the invention.

Referring now to FIG. 1, a first embodiment of the invention is generally designated by the reference numeral 10 and is seen to include a neck strap 1, a cross strap 3, a pair of torso attaching straps 5 and 7, and stretchable securing straps 9 and 11.

It should be first understood that the neck strap 1 and the torso attaching straps 5 and 7 could be made from one piece, or ends of the neck strap 1 could be secured to ends of the attaching straps 5 and 7 by stitching or other known means for attachment. In FIG. 1, the neck strap 1 is shown stitched together with the torso attaching straps 5 and 7 and stretchable article securing straps 9 and 11 as represented by 4. A web material can be employed for straps 1, 3, 5, 7, 9, and 11, such as that used in backpacks and the like. Of course, other materials as are known in the art can also be employed, and certain embodiments employ more resilient materials.

In the FIG. 1 embodiment, a neck pad 12 surrounds the neck strap 1. The neck pad can be any type and have any covering, including camouflage, hunter orange, etc. The pad can be any material that would be resilient to make carrying the article more comfortable such as a foam material or the like. The pad 12 can be slid over the neck strap 1 and secured by stitching, or be made removable by using hook and loop fasteners. In yet another embodiment, the neck pad is optional so that the neck strap 1 itself surrounded a user's neck.

Referring back to FIG. 1, the cross strap 3 can also be made of the same material as the neck and attaching straps 1, 5, and 7, and can be stitched to one or the other, or connected at a junction of each. In the FIG. 1 embodiment, the cross strap 3 is shown stitched between the straps 5 and 7. The cross strap functions to keep the straps 5 and 7 from separating too much when the harness is worn and tend to maintain an opening for the neck.

Extending from the neck strap 1 are a pair of movable article supporting straps 13. Again, these straps can be made from any material but are preferably made of an elastic material for use as described below. Each supporting strap 13 can be adjustable in length via the use of a buckle 15. The buckle has a center bar 16 which has a loop end (not shown) secured thereto. The straps 13 then extend through the slots formed between the buckle ends and the loop for adjustment. Pulling the strap 13 over the bar 16 and loop end adjusts the strap length. This type of adjustment buckle is well known in the art and need no further description. The strap 13 and buckle 15 also form a loop 17, which holds an article supporting device 18.

Figure 2:
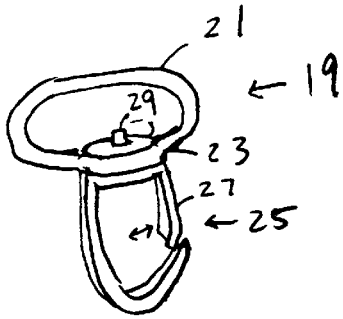
FIG. 2 shows the article supporting device of FIG. 1 enlarged to show greater detail.

Referring to FIG. 2, the embodiment depicted in FIG. 1 is a swiveling or rotatable hook assembly 19. The assembly 19 has a loop 21 with a swivel support 23. Connected to the swivel support 23 is a hook 25, having a movable segment 27 (see arrow for direction of movement) that allows the hook 25 to connect to an article or a ring (not shown), the ring then connecting to the article. The hook 25 has a pin 29 extending from its proximal end, the pin 29 extending through and being secured to the swivel support 23 so that the hook 25 freely rotates about the swivel support 23. This free rotation aspect minimizes rubbing damage to the harness or its components. It is preferred that the assembly 19 is made of a non-metallic material such as a polymer to also reduce rubbing damage.

Figure 5:
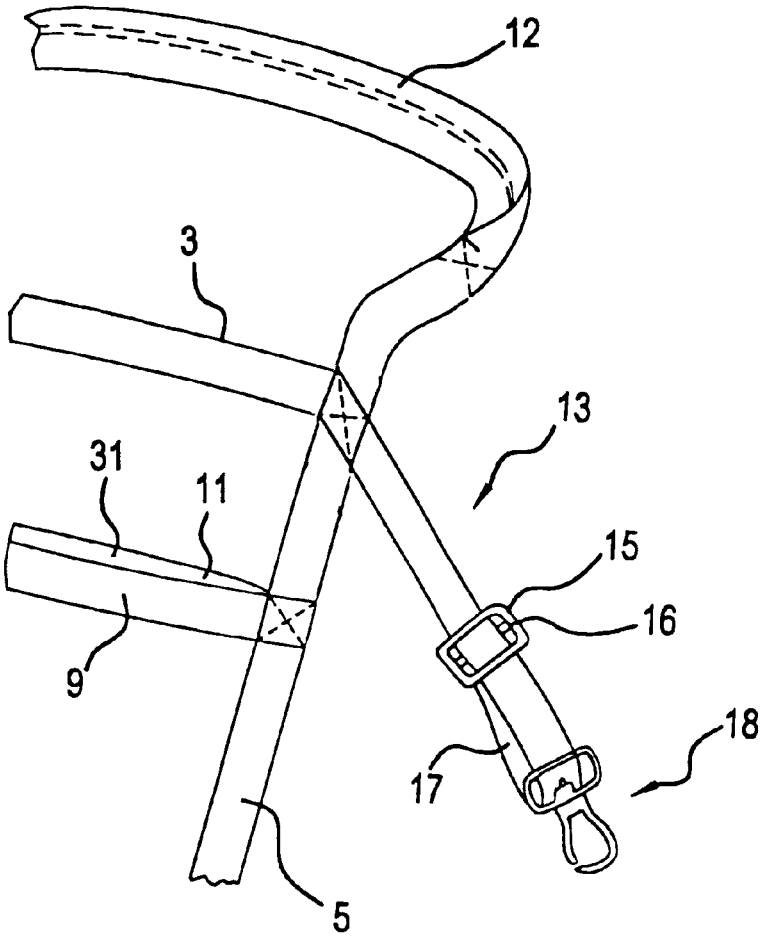
FIG. 5 shows an alternative connection for the article supporting strap.

One end of each of the supporting straps 13 is shown attached to the neck strap 1 by stitching 4, with the other end being free for easy movement of the straps and any article connected thereto. It should be understood that the one end of the movable straps 13 could be attached to the straps 5 and 7, see FIG. 5 which shows a partial view of the harness as shown in FIG. 1 with the end of strap 13 connected to strap 5, or at the junction where the ends of the cross strap 3 engage straps 5 and 7, if desired.

The stationary article securing straps 9 and 11 are made from stretchable material such as an elastic or the like. Ends of each strap are secured to the segments 5 and 7 so that straps 9 and 11 form an opening 31.. The opening can be enlarged due to the stretching nature of the straps 9 and 11 to receive at least a portion the article being carried.

Figure 3:
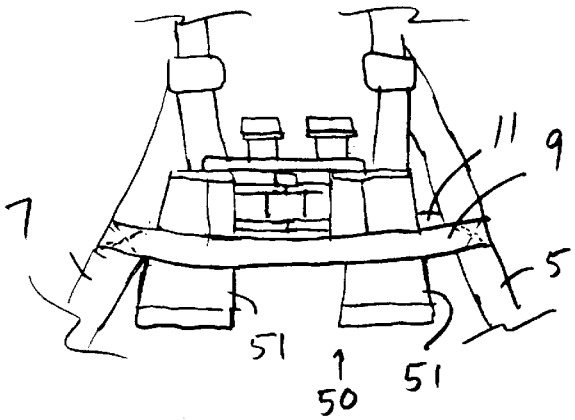
FIG. 3 shows the embodiment of FIG. 1 in an exemplary use.

Referring now to FIG. 3, an article as a binocular 50 is exemplified for use with the harness 10. Barrels 51 of the pair of binoculars 50 can be secured between the straps 9 and 11 so that the binoculars 50 do not move during movement of the harness by the user. This is accomplished by expanding the straps 9 and 11 and inserting the barrels 51 into the opening 31.

Figure 4:
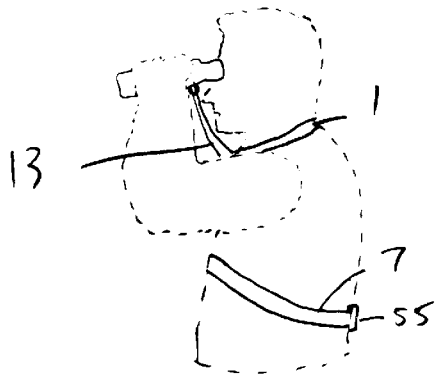
FIG. 4 shows a side view of the harness on a user.

When needed, the binocular barrels 51 can be removed from the opening 31 formed by straps 9 and 11 and raised for use as shown in FIG. 4. FIG. 4 also shows the neck strap 1 and the straps 13 extending below the binoculars 50.

When the supporting straps 13 are made of a stretchable material, the binoculars are more easily maneuvered when being used, thereby providing a free range of movement for the user.

Referring now to FIGS. 1 and 4, ends of the attaching straps 5 and 7 are equipped with connector halves 53 and 55. The connector halves 53,55 shown are the type wherein one half employs a number of fingers that, when compressed together can enter a cavity in the other connector. Once in the cavity, the fingers expand, and protrusions from the fingers engage openings in the sidewall of the cavity to lock the two halves together. Of course, other means for connecting or joining the ends together as would be known in the art can be employed as this component of the inventive harness.

The straps 5 and 7 are also adjustable in length using a buckle arrangement 57, which is similar to those used with the straps 13. Movement of the ends 59 and 61 of the straps 5 and 7, respectively, allows the length to be adjusted. Of course, other adjustment features can be employed.

The straps 5 and 7 are intended to wrap around the user's torso and connect near the user's spine and lower lumbar region, see FIG. 4. This arrangement contributes, in conjunction with the neck strap 1, to an even distribution of the weight of the article being carried. In the FIG. 1 embodiment, the ends of the straps 5 and 7 join the ends of the neck strap 1 and the straps 13 so that the force from the weight of the article is distributed in a more efficient manner. Further, since the straps 5 and 7 contact the lower lumbar region of the back, back fatigue is reduced.

The invention provides an efficient method of storing articles such as binoculars as well as using them with a minimum of effort. Initially, the binoculars would be attached to the swivel hook assembly 19 and the barrel ends 51 of the binoculars 50 would be inserted into the opening 31 between the straps 9 and 11 by expanding the straps. Once the straps are released, they would contract around the barrel ends so that the binoculars, would be carried adjacent the user's chest and would not dangle around and make noise when being carried.

When needed, the user can merely pull the barrels from the straps 9 and 11, and position the eyepieces of the binoculars for viewing. The binoculars are still retained to the harness via the straps 13. Since the straps 13 can be stretchable, the binoculars can be moved in a wide range of motion for viewing but without having to release them from the swivel hook assembly. When done, the barrels 51 can be inserted again between the straps 9 and 11 or the binoculars can be left to hang from the straps 13.

The harness can be made in any color, including black, hunter orange, or another color. Similarly, the neck pad can be made with a camouflage outer covering, or be made of the same or a different color from the segments and straps of the harness.

While binoculars are disclosed, virtually any article can be employed for carrying, e.g., cameras, GPS devices, etc. Besides hunting, the harness can be used in virtually any activity that would require carrying an article, bird watching, hiking, sporting events, and the like. In certain modes, it may be possible to use the article when at least a portion is secured between the straps 9 and 11.

As such, an invention has been disclosed in terms of preferred embodiments thereof, which fulfills each and every one of the objects of the present invention as set forth above and provides new and improved harness for carrying articles and its method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An article carrying harness comprising:

a neck strap of defined length and a pair of torso securement straps connected thereto, each securement strap having a free end and having a length so that the free ends can be positioned in a user's lower lumbar region;

means for joining the free ends together at the user's lower lumbar region;

a pair of stretchable article supporting straps, one end of each supporting strap extending from either the neck strap or a respective securement strap, the other end of each supporting strap having means for attaching to a portion of an article to be carried;

a pair of stretchable bands extending between the securement straps and disposed between the supporting straps and the free ends, the stretchable bands forming an opening to receive and retain a portion of the article being carried.

2. The harness of claim 1 wherein the securement straps are adjustable in length.

3. The harness of claim 1 wherein the supporting straps are adjustable in length.

4. The harness of claim 1, wherein the means for attaching comprise rotatable loops attached to the supporting straps.

5. The harness of claim 1, further comprising a support strap extending between the securement straps.

6. The harness of claim 1, wherein the article is one of a pair of binoculars, a camera, and a global position system device.

7. The harness of claim 1, wherein the neck strap is padded.

8. The harness of claim 1, wherein the article to be inserted is one of a pair of binoculars, a camera, and a global position system device.

9. The harness of claim 1, wherein harness is provided with a padded neck.

10. A method of carrying and using an article comprising:

providing an article carrying harness on a user that includes first and second pairs of stretchable straps;

attaching the ends of the first pair of stretchable straps to the article;

stretching the straps of the second pair away from each other to form an opening and inserting a portion of the article into the opening and releasing the straps to secure the end portion of the article;

removing the end portion of the article from the second pair of straps while keeping the ends of the first pair attached to the article; and stretching the first pair of straps when using the article.

11. The method of claim 10, wherein the article is one of a pair of binoculars, a camera, and a global position system device.

12. The method of claim 8, wherein the stretchable straps are in a harness comprising a neck strap of defined length and a pair of torso securement straps connected thereto, each securement strap having a free end and having a length so that the free ends can be positioned in a user's lower lumbar region;

means for joining the free ends together at the user's lower lumbar region;

one end of each of the first pair of stretchable straps extending from either the neck strap or a respective securement strap, the other end of each supporting strap having means for attaching to a portion of the article to be carried;

the second pair of stretchable straps extending between the securement straps and disposed between the first pair of stretchable straps and the free ends, the second pair of stretchable straps forming an opening to receive and retain a portion of the article being carried.

13. The method of claim 12, wherein the securement straps are adjustable in length.

14. The method of claim 12 wherein the first pair of stretchable straps are adjustable in length.

15. The method of claim 12, wherein the means for attaching comprise rotatable loops attached to the supporting straps.

16. The method of claim 12, wherein the harness is provided with a support strap extending between the securement straps.

* * * * *